US005519904A

United States Patent [19]

Wukicsevics et al.

[11] Patent Number: 5,519,904

[45] Date of Patent: May 28, 1996

[54] BED WITH SLIDABLE COVER COMPRISED OF SLATS

[75] Inventors: Karl Wukicsevics; Rudolf Kisely, both of Vienna, Austria

[73] Assignee: Helmut Schagerl, Vienna, Austria

[21] Appl. No.: 245,704

[22] Filed: May 18, 1994

[30] Foreign Application Priority Data

May 18, 1993 [AT] Austria ..... 974/93

[51] Int. Cl.[6] ..... A47C 17/00; A47C 17/22

[52] U.S. Cl. ..... 5/400; 5/2.1; 5/12.1; 5/159.1

[58] Field of Search ..... 5/2.1, 12.1, 93.1, 5/451, 400, 58, 159.1, 308, 927

[56] References Cited

U.S. PATENT DOCUMENTS

| | | | |
|---|---|---|---|
| 2,243,691 | 5/1941 | Bakalar | 5/93.1 |
| 3,019,454 | 2/1962 | Luca | 5/17 |
| 3,064,276 | 11/1962 | Newsom, III | 5/927 |
| 4,580,679 | 4/1986 | Hellman, III | 206/425 |
| 4,586,206 | 5/1986 | Singer | 5/18 R |
| 4,680,820 | 7/1987 | Bittner | 5/451 |
| 4,756,581 | 7/1988 | Phillips | 312/183 |
| 4,937,900 | 7/1990 | Bridges | 5/927 |

FOREIGN PATENT DOCUMENTS

| | | | |
|---|---|---|---|
| 1406550 | 6/1964 | France . | |
| 173819 | 7/1952 | Germany . | |
| 3410918 | 3/1985 | Germany | 5/2.1 |
| 150999 | 11/1931 | Switzerland . | |

*Primary Examiner*—Alexander Grosz
*Attorney, Agent, or Firm*—Bell, Seltzer, Park & Gibson

[57] ABSTRACT

A bed, comprising a frame having at least two side parts between which there is provided a space for a lying surface of constant area for a person to repose. In order to be able to cover the space with the lying surface when the bed is not in use and then to use the bed as a conventional couch, a respective guide is provided on the side of each side part of the frame facing the lying surface, a covering extending from side part to side part in the respective guide so that the lying surface is displaceably guided.

7 Claims, 2 Drawing Sheets

BED WITH SLIDABLE COVER COMPRISED OF SLATS

BACKGROUND OF THE INVENTION

1. Field of the Invention

The invention relates to a bed, comprising a frame having at least two side parts between which there is provided a lying surface of constant area for a person to repose.

2. Discussion of Prior Art

It is known to construct pieces of furniture with a variable sitting or lying surface which can be used as a sofa or as a bed, depending on the size of this surface. Furniture of this type is described for example in AT-PS 173 819, U.S. Pat. Nos. 3,019,454 or 4,586,206.

It is also conventional to construct beds such that they can also be used, in the case of a lying surface of constant area, as another piece of furniture, such as a couch or the like. However, the bedding has inconveniently to be stowed in a bedding space in the case of conventional constructions or coverings are provided in the form of slip-on covers which in turn have to be kept somewhere while the bed is being used for sleeping and also have inconveniently to be spread over the bed. Moreover, the coverings mentioned do not provide particularly good protection for the bedding which is left on the bed and which becomes crumpled and also subsequently influences comfort during use as a couch.

It is therefore the object of the present invention to provide a bed which eliminates the above disadvantages and which permits the conversion from bed to couch and vice versa without inconvenient stowing of the bedding rapidly, simply and without additional slip-on covers or the like.

SUMMARY OF THE INVENTION

According to the invention, the object is achieved in that there is provided on the side of each side part of the frame facing the lying surface a respective guide which is known per se and in which a covering, extending from side part to side part, for the lying surface is displaceably guided. Thus it is made possible to completely cover the space with the actual lying surface which contains the mattresses and the bedding, without having to handle the bedding and at the same time it is made possible to obtain a usable surface, to be used for example as a couch, by means of the surface of the covering.

A particularly simple and secure construction is produced in that the guide is formed by a groove in the respective side part, which groove is preferably lined with epoxy resin.

In order to be able to accommodate the covering in a space which is as small as possible, according to a further feature of the invention, it is provided that the covering comprises in a manner known per se a plurality of slats of metal, preferably of aluminium or an aluminium alloy, which are connected to one another to be movable about spindles oriented perpendicular with respect to the direction of displacement of the covering and which are preferably constructed in the form of T-shaped profiles. The covering can thus be displaced like a rollbar into a space located in front of, behind or below the actual lying surface, said covering preferably coming to lie below the lying surface, parallel to the floor. The flexibility of the covering which is necessary for the displacement is effected in this first advantageous embodiment by means of the slats which are movably connected to one another. It is thus also ensured at the same time that the covering has a very good bearing capacity, which can advantageously further be improved by the reinforcement of the slats by the webs of the T-shaped profiles, and that the bed in the covered state can also be used as a couch for one or more people.

Another embodiment with a bearing capacity which is almost as good, but with a more lightweight covering, is produced in that the covering comprises a one-piece plate having part sections which are movably connected to one another, which plate is preferably produced by the deep-drawing process, the part sections of the plate preferably being provided with integrally formed webs. In order to design the covering on the one hand to be visually more attractive and to match it to the design of the bed and on the other hand to increase the comfort for those using the bed as a couch, it can advantageously be provided that the slats or the part sections of the plate are provided with a cushioning, an upholstering, a slip-on cover or a sheathing of another material.

The easier displaceability of the covering and thus the easier handlability can be achieved in that in a manner known per se the slats or the part sections of the plate are provided with bearings, preferably ball-bearings secured on spindles in the slats or part sections, which engage in the guide.

Preferably, in order to make the handling even simpler and even easier, in a manner known per se a drive for displacing the covering along the guide is provided and is connected to at least one slat or one part section of the plate. Thus, the user no longer has to apply any force of his own to displace the covering.

According to a first variant, the drive has an electric motor having a spindle which is provided with a screw thread and is mounted rotatably on its ends, on which spindle there is provided a nut which is non-rotatably connected to the at least one slat or the at least one part section.

However, in a manner known per se, a drive having an electric motor having at least one toothed wheel which engages directly in the covering, preferably in the integrally formed webs of the slats or part sections, can also be provided.

According to a last preferred embodiment, the drive is formed by an electric motor and a cable pull moved thereby, the cable pull being connected to at least one slat or one part section.

Further features and advantages of the invention will be described in more detail in the following description, with reference to the attached schematic drawings.

BRIEF DESCRIPTION OF THE DRAWINGS

In the drawings,

In FIG. 1, the side parts 1 of the bed on the left and on the right delimit the space 2 for the actual lying surface containing the conventional inserts, mattresses, bedding etc. A covering comprising a plurality of slats 3 which are movably connected to one another is provided to cover the space 2, together with all the objects provided therein. The slats 3 are displaceable within a groove 4. This groove 4 extends from a rear delimitation 5 beyond a front delimitation 6 into the interior of the bed, as shown in FIG. 1 by the dashed lines. Thus, the slats 3 of the covering are displaceable, together with the lying surface, from a position in which the first slat 3*a* of the covering lies against the rear delimitation 5 or is covered thereby in the manner of a roof, or in overlapping manner, into a second position in which the first slat 3*a* is flush with the front delimitation 6 or is pushed back behind or below the latter.

The groove 4, in order to ensure easier movement of the slats 3 therein and at the same time to be constructed to be resistant to wear, is preferably milled into the material of the side parts 1 and lined with epoxy resin or a similar material.

Figure 2:
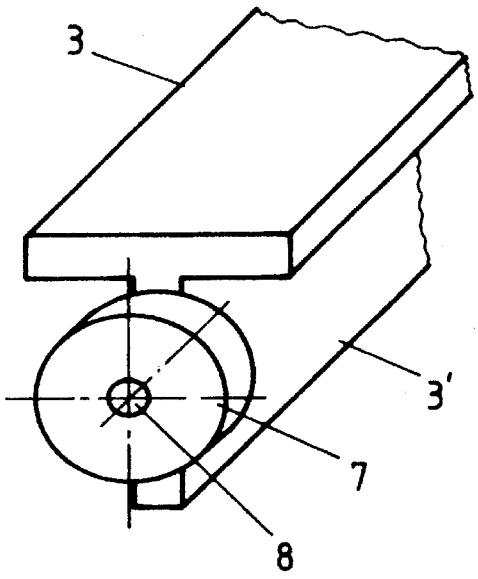
FIG. 2 shows a perspective view of an end of a slat of the covering.

The slats 3 which can of course be constructed according to the design of the bed, i.e. provided with a slip-on cover, upholstered, cushioned etc., are advantageously provided with integrally formed webs 3' in the longitudinal direction of the slats 3, as can be seen clearly in FIG. 2. In order to facilitate the displacement of the slats 3 of the covering in the groove 4 and reduce wear whilst using as little force as possible, the ends of the slats 3 engaging in the grooves 4 of the side parts 1 are provided with rollers 7, ball-bearings or the like, which are mounted on spindles 8 which are preferably fixed in the webs 3'.

Figure 3:
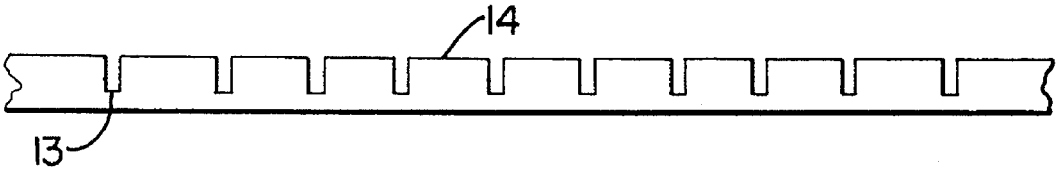
FIG. 3 shows a side view of an embodiment of a one-piece plate usable in the present invention.

The slats 3 are preferably connected to one another by adhering a flexible mat or the like to the side of the slats remote from the lying surface. The mat is preferably made of rubber. In order to improve further the connection between the slats and the mat strips of wood, metal or other materials can be arranged on the side of the rubber mat opposite the slats and can be connected to the slats through the mat, preferably screwed or riveted. The strips are then preferably constructed according to the design of the bed, i.e. provided with a slip-on cover, upholstered, cushioned. Metal, which has the best bearing capacity, is preferably provided as the material for the slats 3. If aluminium T-shaped profiles are used, a covering which is also very lightweight and thus easy to displace is produced. Even more lightweight constructions of the covering are possible by the use of a one-piece plate, as illustrated, for example, in FIG. 3, preferably produced by the deep drawing process. In this case, thinner sections 13 are provided between thicker part sections 14 corresponding to the slats 3 in order to enable a pivoting of the thicker part sections with respect to one another. Advantageously, during deep drawing, reinforcements of the thicker part sections corresponding identically to the webs 3' are formed. In the latter variant for the covering, connection to a flexible mat can of course be dispensed with.

Figure 1:
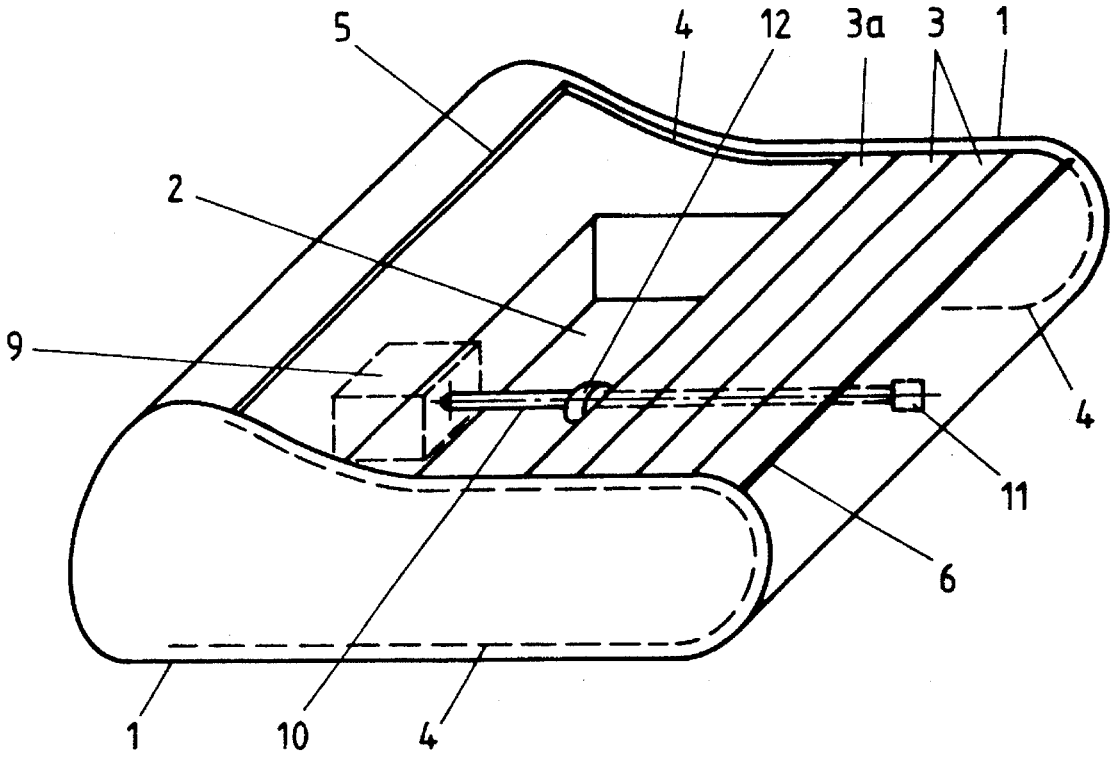
FIG. 1 shows a perspective view of a bed according to the invention.

The displacement of the slats 3 of the covering can be carried out manually in the simplest embodiment, but is advantageously carried out by a drive system. In FIG. 1, there is schematically illustrated in a dashed illustration an electric motor 9 which causes a spindle 10 provided with a thread to rotate. The direction of the rotation is reversible, either by a change gear provided between electric motor 9 and spindle 10 or by reversing the direction of rotation of the electric motor 9 itself. At its end opposite the electric motor 9, the spindle 10 is mounted rotatably at 11. Provided on the spindle 10 is a nut 12 which is connected non-rotatably to at least one of the slats 3 of the covering. Thus, when the spindle 10 rotates, the nut 12 is displaced along the latter and thus also moves the covering in the same manner. As a result of the relatively great length of the spindle 10, to prevent excessive flexing thereof, the nut 12 itself or an additional slide block (not illustrated) is guided on the spindle 10 in guides on the base of the bed parallel to the latter. As an alternative to the actuation of the covering described in the previous paragraph, the electric motor 9 can also drive toothed wheels which directly engage the covering, preferably engage between the slats 3, preferably against the webs 3'. Alternatively, the electric motor 9 can actuate a cable pull which is preferably guided in the grooves 4.

We claim:

1. A bed, comprising a frame having at least two side parts between which there is provided a means providing a lying surface of constant size, and a covering, wherein there is provided, on a side of each side part of the frame facing the lying surface, a respective guide, wherein said guide is formed by a respective groove in the respective side part in which said covering for said lying surface is displaceably guided, extending from one side part to the other side part, wherein said covering comprises a plurality of slats of metal which are connected to one another, which to be movable are provided with roller means which engage in said guides, said roller means being secured on spindles oriented perpendicular in the slats with respect to the direction of displacement of the covering.

2. A bed according to claim 1, wherein the slats are provided with an item selected from the class consisting of a cushioning, an upholstering, a slip-on cover or a sheathing of another material.

3. A bed according to claim 1, wherein the slats are provided with bearings which are secured on spindles in the slats, which engage in the guides.

4. A bed according to claim 1, wherein a drive for displacing the covering along the guide is provided and is connected to at least one slat.

5. A bed, comprising a frame having at least two side parts between which there is provided a means providing a lying surface of constant size, and a covering, wherein there is provided, on a side of each side part of the frame facing the lying surface, a respective guide, wherein said guide is formed by a respective groove in the respective side part in which said covering for said lying surface is displaceably guided, extending from one side part to the other side part, wherein said covering comprises a one-piece plate having a plurality of alternating relatively thicker and thinner part sections which are movably connected to one another.

6. A bed according to claim 5, wherein the part sections of the plate are provided with bearings which are secured on spindles in the part sections, which engage in the guides.

7. A bed according to claim 5, wherein a drive for displacing the covering along the guide is provided and is connected to at least one part section of the plate.

* * * * *